US005842930A

United States Patent [19]

Koterba

[11] Patent Number: 5,842,930

[45] Date of Patent: Dec. 1, 1998

[54] FLEXI-GRIP GOLF CLUB

[76] Inventor: Dan Koterba, 142-14 26th Ave., Apt. 4H, Flushing, N.Y. 11354

[21] Appl. No.: 867,561

[22] Filed: Jun. 2, 1997

[51] Int. Cl.[6] ..... A63B 53/14

[52] U.S. Cl. ..... 473/201; 473/300; 473/409

[58] Field of Search ..... 473/201, 202, 473/203, 204, 205, 206, 300, 301, 302, 303, 304, 226, 294, 257, 232, 409

[56] References Cited

U.S. PATENT DOCUMENTS

| | | | |
|---|---|---|---|
| 1,201,728 | 10/1916 | Henry | 473/204 |
| 4,625,965 | 12/1986 | Mullins | 473/204 |
| 5,169,152 | 12/1992 | Marquardt | 473/201 |
| 5,190,291 | 3/1993 | Melvin | 473/232 |
| 5,322,290 | 6/1994 | Minami | 473/300 |
| 5,452,891 | 9/1995 | Thomas | 473/300 |
| 5,634,859 | 6/1997 | Nesbitt | 473/301 |
| 5,733,204 | 3/1998 | Carrara | 473/204 |

*Primary Examiner*—Sebastiano Passaniti
*Attorney, Agent, or Firm*—Michael I. Kroll

[57] ABSTRACT

A golf club (10) for use in striking a golf ball (20). The golf club (10) includes a head portion (14) for contacting the golf ball (20) and a flexible grip portion (18) including an outer gripping layer (40) having a top section (38) and a bottom section and an inner flexible layer (44) positioned within the top section (38) for gripping by a golfer (12). A solid shaft (16) is connected between the head portion (14) and flexible grip portion (18) and is positioned to extend through the bottom section of the flexible grip portion (18) to provide rigidity thereto while the flexible portion (38) remains flexible and able to bend from its position parallel to the shaft (16) during use.

6 Claims, 5 Drawing Sheets

| | NORMAL CLUB (PRIOR ART) | INSTANT INVENTION INCREASE | TOTAL INSTANT INVENTION |
|---|---|---|---|
| ARC OF SWING | "B" | "C" | "D" |

FIG 2A

FLEXI-GRIP GOLF CLUB

BACKGROUND OF THE INVENTION

1. Field of the Invention

The instant invention relates generally to sports equipment and, more specifically, to golf clubs having a flexible grip portion.

2. Description of the Prior Art

Numerous golf clubs and grip portions therefore have been provided in the prior art. For example, U.S. Pat. Nos. 3,674,267; 4,082,273; 4,252,319; 4,979,743 and 5,160,139 are all illustrative of such prior art. While these units may be suitable for the particular purpose to which they address, they would not be as suitable for the purposes of the present invention as heretofore described.

A grip for the elongated handle of a game device, such as a racket or golf club, which may be interchanged with other grips to provide different hand engaging diameters, all of the grips telescopingly fitting the shank of the handle on which it is assembled, the grip being positioned on the shank in various positions lengthwise of the shank to vary the effective length of the handle.

A tennis racket or other striking implement for minimizing the shock imparted to the arm of the user, having a head or striking portion and a handle portion provided with a longitudinal slot lying in a plane substantially parallel to the striking face, said handle having a longitudinal hole in the end thereof remote from the striking head to accommodate an insert of resilient elastic material slightly larger than the hole diameter such as to produce spreading of the parts of the handle on either side of the slot when the insert is introduced into the hole, and a grip-enhancing binding on the handle applied in a manner to urge the two parts of the handle together and to compress the insert. Preferably the insert is of highly compressed rubber, but it may comprise natural or synthetic rubber. The invention may be applied to striking implements having handles made of wood as well as to those having tubular handles of metal, fiberglass or other materials.

Golf swing training apparatus for advising a player of the sequence of the force factors in the swing of a club in a golf shot comprising a housing having an upper end flexibly mountable on the shaft of a club at a point adjacent the top of the off-target hand and a lower end at the bottom of the off-target hand in gripping the club. The upper end is movably attached to the shaft to allow the housing to rock on the shaft away from and toward the target during the swing. The housing separates the player's off-target hand from direct contact with the shaft and the housing's rockability disassociates off-target side direct control and direct application of force on the shaft during the backswing and the first part of the downswing. This tends to substantially reduce off-target side influence in the swing leaving the player in the position where he is influenced to exert initial dominant control and force of the swing through his target side. A lower bead is provided for locating the apparatus in the off-target hand at the first joint of the fingers and not on the palm. Radial flanges are provided for centering the "V" between the thumb and forefinger of the off-target hand on the shaft.

An improved golf putter is provided utilizing a golf grip connected to the shaft at a single point away from the vibrational nodes on the shaft within the grip. The grip is hollow and bell shaped so that both by shape and by composition of the matter of the grip, resonance or ringing of the grip is enhanced. A lower portion of the grip flares outwardly in the open bell shape not only to enhance resonance but also to provide a hard surface of enlarged diameter in contact with the fingers and palms of the player. This bell shaped portion is the dominant portion which controls the stroke of the putter and therefore allows an improved sense of feel to the player from the impact of the ball. In addition, any disturbing torques which are applied to the player's hands are more easily resisted by means of the enlarged ball shaped grip diameter.

A sports equipment having a shaft connected between a handle for gripping by a user during play and a working end such as a head against which a ball may be impacted wherein the handle is formed with a rigid sleeve member adapted to encircle one end of the shaft and an elastic media element positioned between the sleeve member and the applied end of the shaft. Gripping and swinging of the sports equipment by the user when grasping the handle effects longitudinal rocking movement of the sleeve member relative to the applied end of the shaft and thereby provide integrated force of the fingers of the user of the equipment upon the working end thereof.

BRIEF SUMMARY OF THE INVENTION

The present invention is concerned with sports equipment and, more specifically, to golf clubs having a flexible grip portion.

A primary object of the present invention is to provide a golf club having a flexible grip that will overcome the shortcomings of prior art devices.

Another object of the present invention is to provide a golf club having a flexible grip which will increase the force at which the golf club strikes a ball and thus increase the driving distance.

An additional object of the present invention is to provide golf club having a flexible grip which reduces the effects of twisting of the hands by a user during swinging whereby the golf club will strike the ball more squarely thereby reducing the amount of hook or slice imparted to the ball.

Another object of the present invention is to provide a golf club having a flexible grip which increases the distance traveled by the head of the golf club and thus increases the speed of the golf club through the swing and the distance traveled by the ball.

A further object of the present invention is to provide a golf club having a flexible grip of a length able to accommodate at least one of a golfer's hands.

An even further object of the present invention is to provide a golf club having a flexible grip whereby the grip portion is bendable from its aligned position with the shaft and head portion.

A still further object of the present invention is to provide a golf club having a flexible grip that is simple and easy to use.

An even further object of the present invention is to provide a golf club having a flexible grip which is economical in cost to manufacture.

A golf club for use in striking a golf ball is disclosed by the present invention. The golf club includes a head portion for contacting the golf ball and a flexible grip portion including an outer gripping layer having a top section and a bottom section and an inner flexible layer positioned within the top section for gripping by a golfer. A solid shaft is connected between the head portion and flexible grip portion and is positioned to extend through the bottom section of the flexible grip portion to provide rigidity thereto while the flexible portion remains flexible and able to bend from its position of alignment with the shaft during use.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 2A is a chart diagram indicating the swing arc for each arc shown in FIG. 2;

DESCRIPTION OF THE REFERENCED NUMERALS

Figure 1:
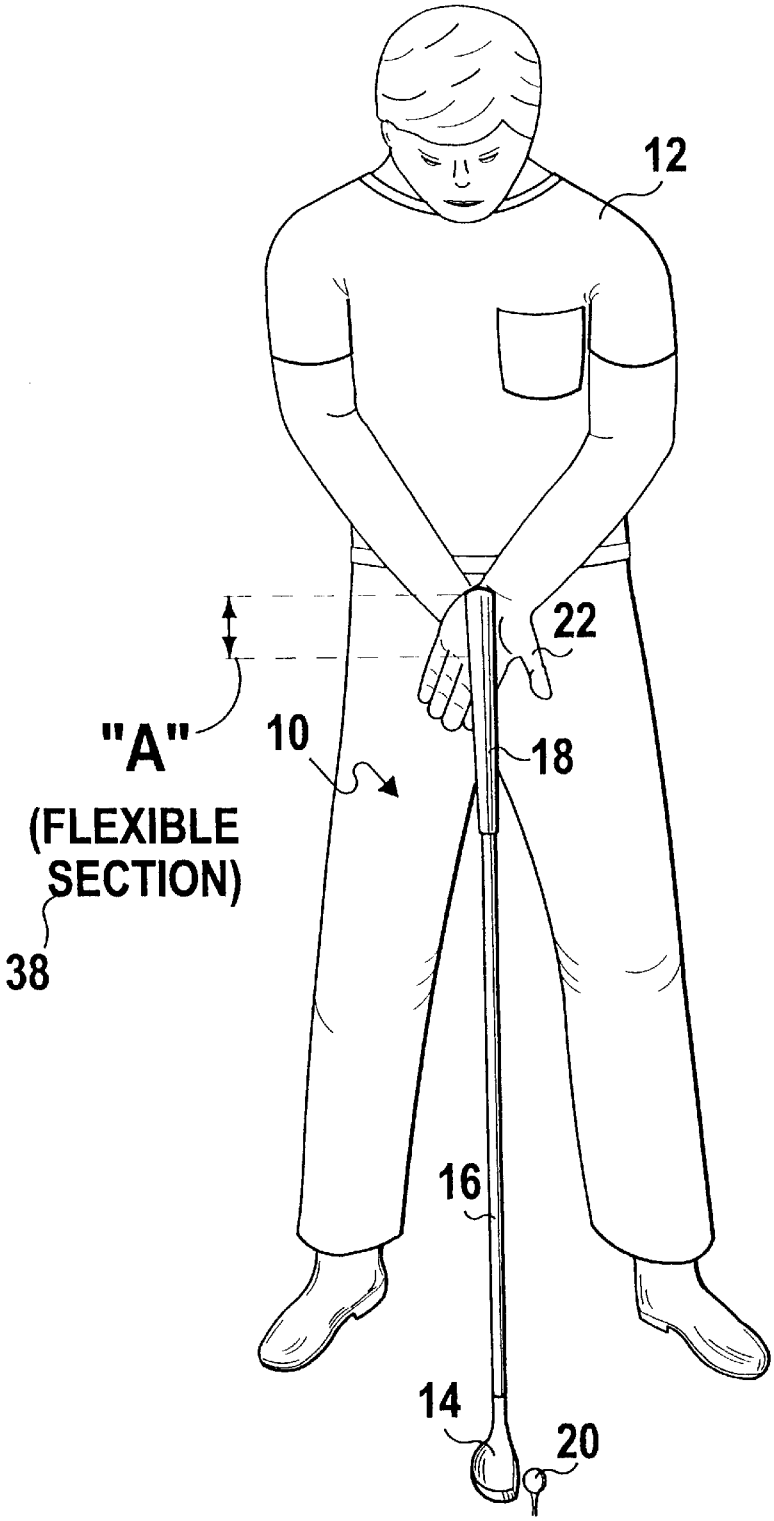
FIG. 1 is a front perspective view of a golfer gripping the golf club including the flexible grip portion of the present invention.

Turning now descriptively to the drawings, in which similar reference characters denote similar elements throughout the several views, the Figures illustrate a golf club including a flexible grip portion of the present invention. With regard to the reference numerals used, the following numbering is used throughout the various drawing figures.

10 golf club including flexible grip portion
12 golfer
14 head portion of golf club
16 shaft of golf club
18 grip portion of golf club
20 golf ball
22 upper hand of golfer
24 lower hand of golfer
26 club position midway through backswing
28 highest position of golf club during normal backswing
30 highest position of golf club with flexible grip during extended backswing
32 arc indicating normal backswing
34 arc indicating difference between normal and extended backswings
36 arc indicating extended backswing
38 flexible section of grip portion of golf club
40 outer layer of grip portion
42 shaft section extending partially within outer layer of grip portion
44 flexible material within top end of grip portion
46 relaxed position of grip portion
48 flexed position of grip portion
50 angle between relaxed and flexed positions of grip portion
52 lower rigid section of grip portion

DETAILED DESCRIPTION OF THE PREFERRED EMBODIMENT

A preferred embodiment of the golf club including a flexible grip portion in accordance with the present invention will now be described with reference to FIGS. 1–4.

Specifically, FIG. 1 shows the golf club of the present invention indicated generally by the numeral 10 being grasped by a golfer 12. The golf club 10 includes a head portion 14, a shaft 16 and a grip portion 18. The grip portion 18 includes an upper flexible section 38 and a lower rigid section 52. The golf club 10 is used to strike a golf ball 20 with the head portion 14.

Figure 2:
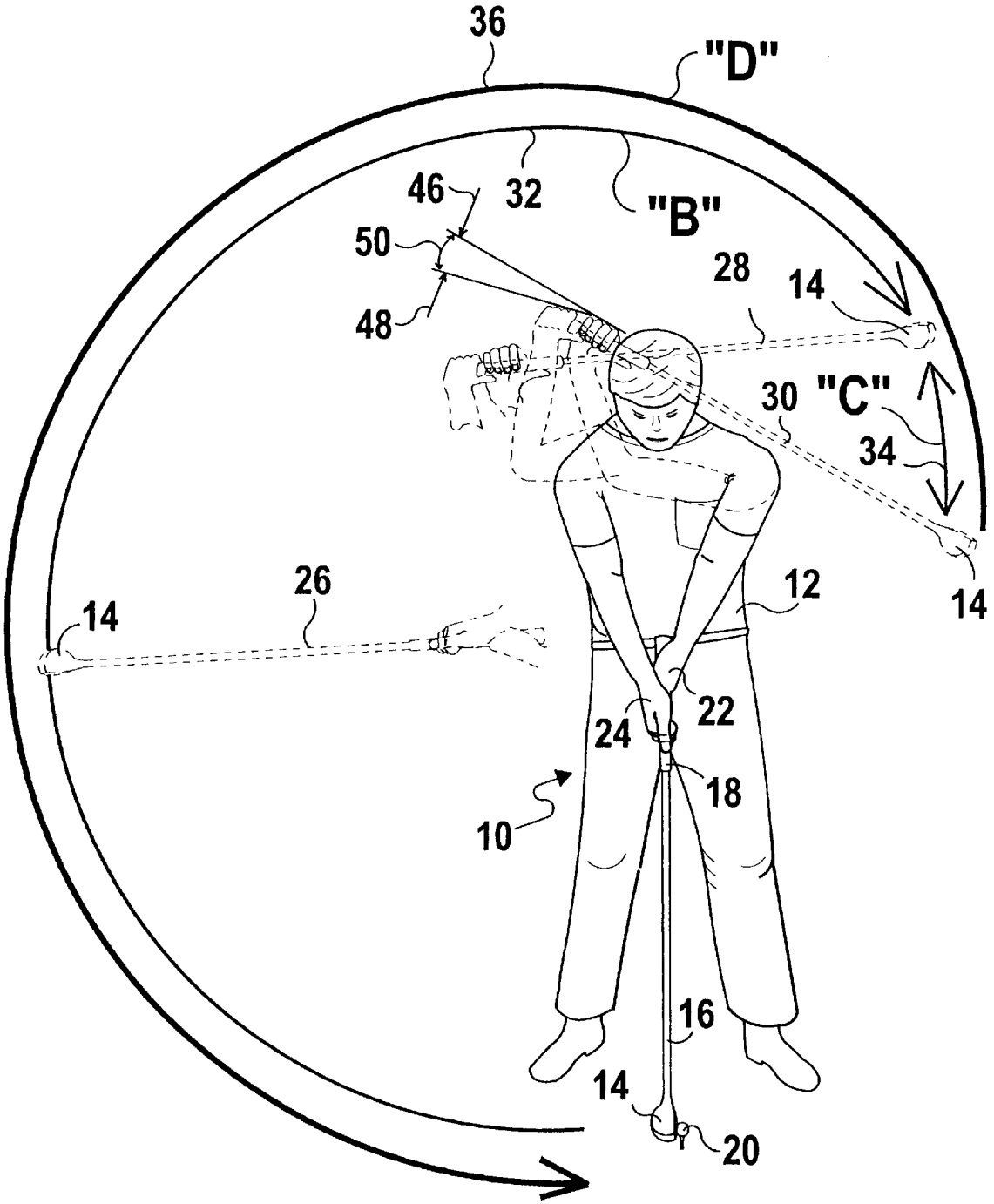
FIG. 2 is a front perspective view illustrating the swinging motion of a golfer using the golf club including the flexible grip portion of the present invention.

The golf club 10 is grasped by a top hand 22 of a golfer 12 at the upper flexible section 38 of the grip section 18. A second lower hand 24 of the golfer 12 grasps the lower rigid section 52 of the grip section 18 at a position below the top hand 22 as illustrated in FIG. 2. The figures illustrate a right handed golfer although the flexible grip golf club 10 can be produced using left handed golf clubs for use by left handed golfers. Furthermore, the drawings illustrate the use of the flexible grip on a driver club while it is also possible to incorporate the flexible grip portion on an iron, wedge or even a putter. Use of a right handed golfer and a driver club are for purposes of example only and not meant to limit the scope of the present invention in any way.

FIG. 2 illustrates the use of the flexible grip golf club 10 as opposed to a golf club having a conventional non-flexible grip portion. The initial portion of the backswing for both conventional golf clubs and the flexible grip golf club 10 of the present invention is identical as illustrated by the dashed club outline labeled with the number 26. As the golf club 10 is raised further through the backswing, the motion of the golf club during a conventional backswing ceases at a position extending substantially perpendicular to the ground as illustrated by the dashed golf club outline labeled with the number 28. In this position, the knuckles of the top hand 22 of the golfer 12 also extend in a plane substantially perpendicular to the ground. Using a conventional golf club, it would not be advantageous to bring the club back past a position parallel with the ground as it would increase the difficulty of striking the golf ball 20 squarely when swinging the golf club. The distance traveled by the head portion 14 of the golf club 10 is represented by the arc "B" labeled with the number 32.

When using a golf club 10 including a flexible grip portion 38 in accordance with the present invention, the head 14 of the golf club 10 is caused to extend further behind the golfer 12 to a position past the perpendicular position of a conventional swing as illustrated by the dashed outline of a golf club labeled with the number 30. In this position, the knuckles of the top hand 22 of the golfer 12 remains substantially parallel to the ground in a manner similar to the conventional golf swing. The head portion 14 is caused to bend past the parallel position due to the weight of the shaft 16 and head portion 14, the flexibility of the grip portion 18 and the pressure applied to the grip portion 18 by the golfer 12. These factors cause the golf club 10 to bend at the point at which the flexible section 38 meets the shaft 16, i.e. between the upper flexible section 38 and the lower rigid section 52. The distance traveled by the head portion 14 of the golf club 10 having a flexible grip portion 38 in accordance with the present invention is shown by the arc "D" labeled with the number 36. The difference in the position of the head portion 14 of the golf club 10 during a conventional backswing and a backswing using a golf club 10 having a flexible grip portion 38 is illustrated by the arc "C" labeled 34. The use of the flexible grip portion 38 causes the golf club 10 to swing in a pendulum like manner, the secured pivot point of the pendulum being the point between the upper flexible section 38 and lower rigid section 52 of the grip portion 18, and thus acts to correct the positioning of the head portion 38 of the golf club 10 to strike the ball 20 squarely as aligned.

When the head 14 of the golf club 10 reaches its extended back swing position an angle exists between the position of the upper hand 22 with respect to the lower hand 24. This angle is indicated in FIG. 2 by the number 50. This angle 50 is measured by the distance between an extended plane 46 formed by the knuckles of the lower hand 24 and an extended plane 48 formed by the knuckles of the upper hand 22. Due to the flexible nature of the upper flexible section 38 of the grip portion 18, when the golf club 10 is brought back through the back swing the force applied by the golfer 12 in gripping the golf club 10, the flexibility of the grip portion 18 and the weight of both the shaft 16 and head portion 14 cause the flexible section 38 to bend at an angle away from the plane formed by the knuckles of the top hand 22, substantially parallel to the ground, and towards the ground. This angle 50 is clearly seen in FIG. 4. As the top hand 22 of the golfer 12 is positioned to be substantially perpendicular to the ground at the apex of the backswing the flexibility of the grip portion 18 causes the head portion 14 of the golf club 10 to extend past the perpendicular position of the conventional backswing. Thus, the club head portion 14 must travel further as indicated by the arc "D" 36 to strike the ball 20.

The increased distance traveled by the club head 14 and the additional elastic force provided by the flexible section as the golf club 10 is swung causes an increase in the speed of the golf club 10 and therefore the club head portion 14. Thus, the club head portion 14 has an increased momentum immediately prior to the point at which it strikes the ball 20 and is able to strike the ball 20 with a greater force. The increase in speed is due to acceleration of the club head portion 14 through the additional traveling distance through which the golf club 10 travels and the effect of gravity on the club head portion 14 for an extended period of time. The increased speed also increases the momentum of the club head portion 14 and thus allows the club head portion 14 to strike the ball 20 with a greater force. As is evident from general laws of physics, striking the ball 20 with this increased force will cause the ball 20 to travel further and thus increase the distance of the shot beyond that obtained with a conventional swing.

As part of the grip portion 18 is flexible, the effects caused by twisting ones hands during the swinging motion are reduced. When using a conventional non-flexible grip, any twisting of ones hands is directly imparted to the club head portion 14 and thus the club head portion 14 will not strike the ball 20 at the proper position, also known as the "sweet" spot, on the club head portion 14. The direct effect of the hand twisting on the club head portion 14 is a decrease in the amount of forgiveness on off-center hits of the ball 20 and thus a decrease in the size of the "sweet" spot. This is because the club head portion 14 is unable to compensate for the twisting and thus must strike the ball 20 in a select particular position for a square hit of the ball 20.

The use of the flexible grip portion 18 reduces the effects of twisting the top hand 22. When the top hand 22 is twisted during the swing, the flexibility of the grip portion 18 causes the grip portion alone to twist until it reaches its critical point. The critical point is a function of the flexibility of the material of which the grip portion 18 is formed. Once the critical point is reached, the twisting of the hands 22, 24 and the grip portion 18 is imparted to the golf club 10 and club head portion 14 thus delaying the effect of the twist. By delaying the application of the twist to the club head portion 14, the club head portion 14 is able to complete a larger portion of the swing before any twisting effects are applied thereto and thus the golf club 10 is able to at least partially compensate for the twisting of the hands. The ability to delay and thus compensate for the twisting of the hands provides the flexible grip golf club 10 of the present invention with a greater moment of inertia, a larger "sweet" spot and thus also an increased forgiveness on off-center hits. The moment of inertia is a measurement of a body's resistance to twisting. As the club head portion 14 does not begin to twist until a delay period expires, the club head portion 14 has an increased moment of inertia as it resists the twisting motion and will deviate from its position of alignment with the ball 20 by a reduced amount. This allows the club head portion 14 to strike the ball 20 in a more aligned position and thus more squarely with its "sweet" spot to reduce the effects of twisting the hands 22 and 24, i.e. hooks and slices imparted to the ball 20, and increase the length of an average drive.

Figure 3:
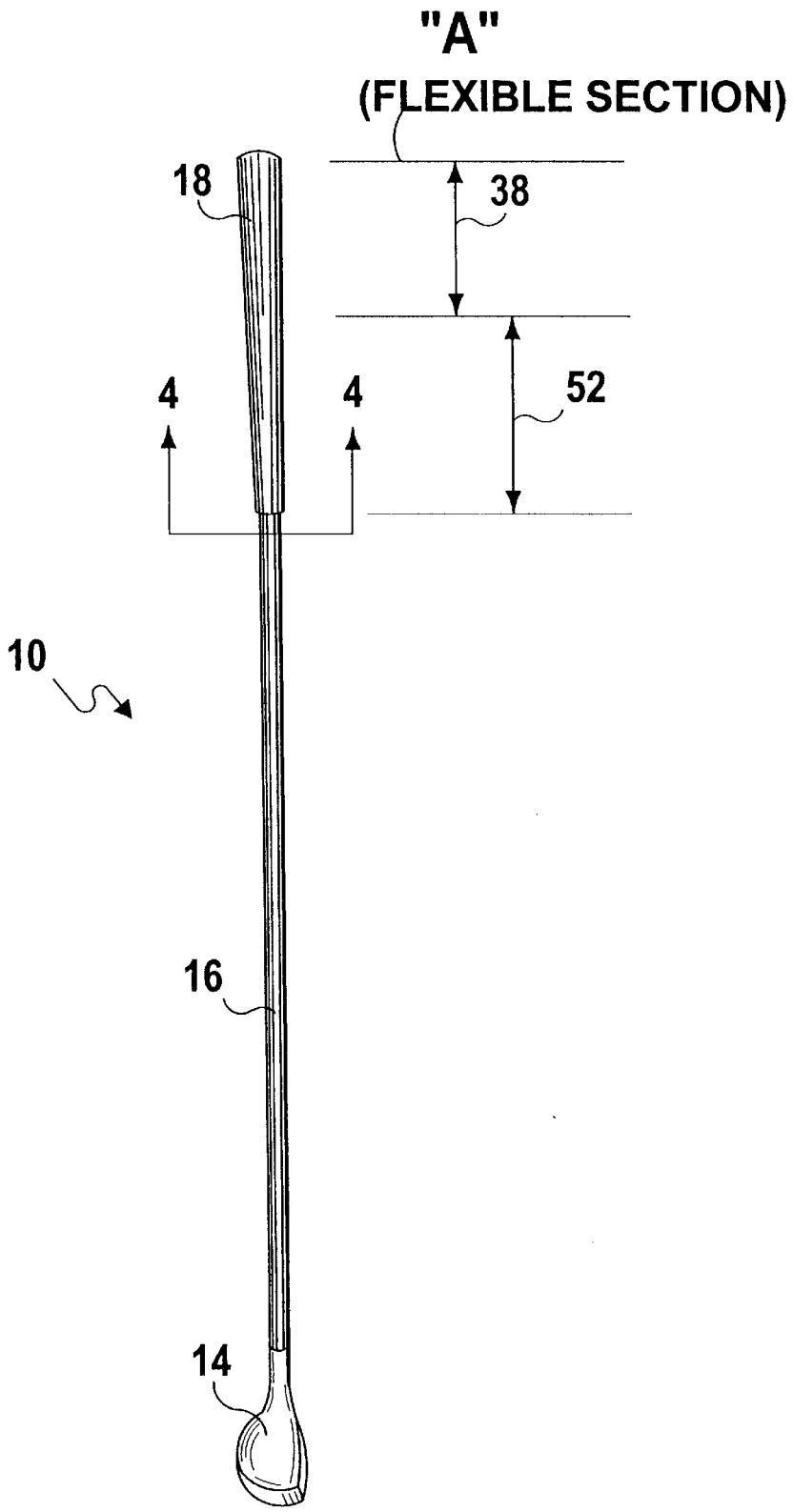
FIG. 3 is a perspective view of the golf club including the flexible grip portion of the present invention.
Figure 4:
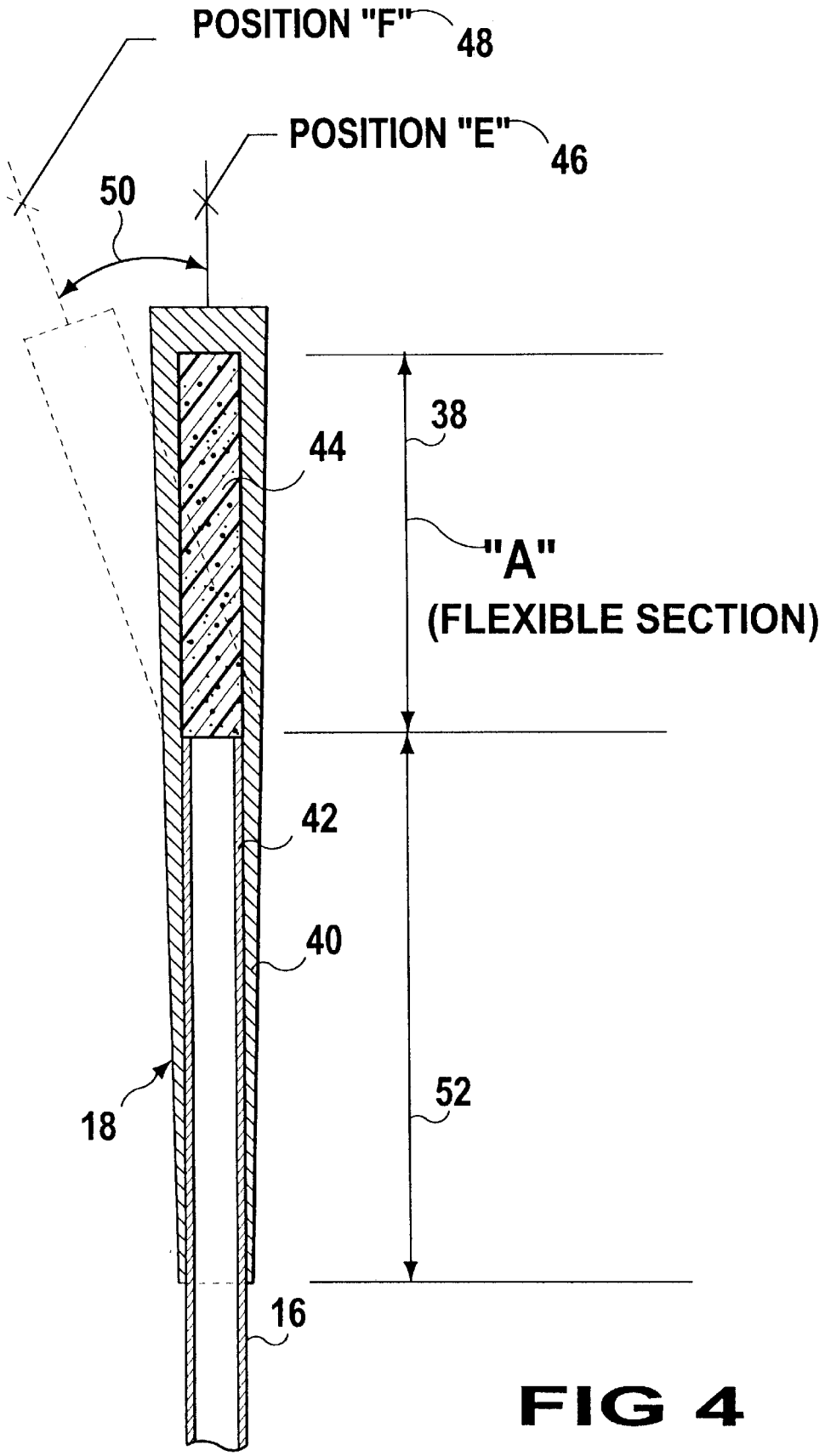
FIG. 4 is a cross-sectional view of the flexible grip portion of the golf club of the present invention.

The golf club 10 is illustrated in FIG. 3 with a cross section of the grip portion 18 shown in FIG. 4. As is evident from FIGS. 3 and 4, the flexible section 38 extends for only a portion of the length of the grip portion 18. The solid shaft 16 is made of a non-flexible material 42 and as is illustrated in FIG. 4 extends only partially into the grip portion 18. The portion of the solid shaft 42 extending into the grip portion is covered by an outer gripping layer 40 to form the lower rigid section 52. Positioned above the solid shaft 16 and within the outer gripping layer 40 is a flexible inner layer 44. The flexible inner layer 44 is made out of rubber or any other elastomeric material which is sufficiently flexible to bend a predetermined amount from its position of alignment with the shaft during the backswing of a golf stroke while retaining a sufficient amount of rigidity so as to prevent the golf club from bending past a predetermined point. The flexible section 38 is preferably substantially three (3) inches in length although the length may vary. The length of the flexible section 38 needs to be long enough to accommodate the top hand 22 of the golfer 12 and based upon the grip used to hold the club 10 possibly the pinky, ring finger and/or middle finger of the bottom hand 24. If the golfer 12 is right handed, the top hand 22 would be the left hand and if the golfer 12 is left handed, the top hand 22 would be the right hand.

The shape of the grip portion 18 is preferably mushroom shaped, such as the handle of a baseball bat, for preventing slippage of the golf club 10 from the golfer's hands during swinging. However, any shape which is comfortable for the golfer 12 and allows the golfer 12 the ability to swing the golf club 10 in the appropriate manner may be used.

The outer layer 40 of the gripping portion 18 is made from a durable material which is preferably tear resistant while also preventing slippage of the golfer's hands during swinging. The use of the tear resistant material for the outer layer 40 of the gripping portion 18 provides an extended life for the gripping portion and avoids the need to constantly replace the grip. The tear resistant material may be any one of leather, rubber, rubber composition, cord and any combination thereof.

While a preferred structure for the flexible grip portion is shown and described herein, those of ordinary skill in the art who have read this description will appreciate that there are numerous other structures for the flexible grip portion 18 and, therefore, as used herein the phrase "flexible grip portion" should be construed as including all such structures as long as they achieve the desired result of bending at a flexing point and reducing the effects of twisting of a golfer's hands during a swing, and therefore, that all such alternative mechanisms are to be considered as equivalent to the one described herein.

It is thus evident that the present invention is able to provide a golf club which will overcome the shortcomings of the prior art. The golf club of the present invention includes a flexible grip which will increase the force at which the golf club strikes a ball and thus increase the driving distance. The flexible grip on the golf club of the present invention also reduces the effects of twisting of the hands by a user during swinging and thus the golf club will strike the ball more squarely thereby reducing the amount of hook or slice imparted to the ball. The distance traveled by the head of the golf club is also increased and thus the speed of the golf club through the swing and the distance traveled by the ball is also increased. Furthermore, the golf club of the present invention is simple and easy to use and economical in cost to manufacture.

It will be understood that each of the elements described above, or two or more together, may also find a useful application in other types of applications differing from the type described above.

While the invention has been illustrated and described as shown in the drawings, it is not intended to be limited to the details shown, since it will be understood that various omissions, modifications, substitutions and changes in the forms and details of the formulation illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of this invention.

What is claimed as new and desired to be protected by Letters Patent is set forth in the appended claims:

1. A golf club for use in striking a golf ball, comprising:

a) a head portion for contacting the golf ball during striking of the golf ball;

b) a single, integral flexible grip portion including an outer gripping layer and having a top section and a bottom section, and an inner flexible core positioned within said top section, the length of said top section being long enough to accommodate one hand of a golfer and the length of said bottom section being long enough to accommodate the other hand of the golfer; and c) means comprising a solid shaft of material less flexible than said top section connected between said head portion and said flexible grip portion extending through the bottom section thereof and terminating at an upper end of said bottom section so that said golf club bends significantly only in said top section during normal use of said club.

2. The golf club as recited in claim 1, wherein said head portion is formed as a driver.

3. The golf club as recited in claim 1, wherein said head portion is formed as an iron.

4. The golf club as recited in claim 1, wherein said head portion is formed as a wedge.

5. The golf club as recited in claim 1, wherein said head portion is formed as a putter.

6. A method of using a golf club comprising the following steps:

a) grasping a golf club comprising a head portion for contacting the golf ball, a single, integral grip portion including an outer gripping layer and having a top section and a bottom section, an inner flexible core within said top section, the length of said top section being long enough accommodate one hand of a golfer and the length of said bottom section being long enough to accommodate the other hand of the golfer, and means comprising a solid shaft of material less flexible than said top section connected between said head portion and said grip portion extending through the bottom section thereof and terminating at an upper end of said bottom section so that said golf club bends only in said top section during normal use of said club;

b) placing one hand on said flexible grip over said top section and another hand over said bottom section; and c) swinging said club causing said club to bend significantly only in said top section during the back swing causing increased momentum of said club during the forward swing.

* * * * *